US006260468B1

(12) United States Patent
Ryken et al.

(10) Patent No.: US 6,260,468 B1
(45) Date of Patent: Jul. 17, 2001

(54) SINGLE-PIECE PROPORTIONAL CONTROL

(75) Inventors: James D. Ryken, Roland; David D. Dirks, Ames; Wilhelm Göllner, Neumünster; Doug Kardell, Grimes, all of IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/390,130

(22) Filed: Sep. 3, 1999

Related U.S. Application Data

(63) Continuation-in-part of application No. 09/390,128, filed on Sep. 3, 1999.

(60) Provisional application No. 60/121,861, filed on Feb. 26, 1999, provisional application No. 60/121,948, filed on Feb. 26, 1999, and provisional application No. 60/121,947, filed on Feb. 26, 1999.

(51) Int. Cl.[7] ..... F01B 3/02

(52) U.S. Cl. ..... 91/506

(58) Field of Search ..... 91/499, 506, 382; 92/12.2, 57, 71

(56) References Cited

U.S. PATENT DOCUMENTS

| | | | |
|---|---|---|---|
| 2,931,250 | 4/1960 | Ebert . | |
| 3,142,963 | 8/1964 | Thoma . | |
| 3,148,628 | 9/1964 | Boydell . | |
| 3,803,987 | 4/1974 | Knapp | 91/506 |
| 3,958,496 | 5/1976 | Wallin . | |
| 4,893,549 | 1/1990 | Forster . | |
| 5,160,245 | 11/1992 | Geringer | 91/506 |

OTHER PUBLICATIONS

"Data Sheet for Variable Pump/Motor V20," Volvo Hydraulics, pp. 1–4, published prior to 1980.

"Hydrostatics for power split transmissions," E. Skirde & M. Gigling, Industrial Vehicle Technology '98, pp.30–33, published , 1998.

*Primary Examiner*—F. Daniel Lopez
(74) *Attorney, Agent, or Firm*—Zarley, McKee, Thomte, Vorhees & Sease

(57) ABSTRACT

A variable displacement bent axis hydraulic unit includes a control mechanism having a control housing with a displacement feedback sleeve and spool connected by a spring. A computer controls a proportional solenoid fluid valve that is in operative fluid engagement with the end of the spool opposite its spring connection with the displacement feedback sleeve. The displacement feedback sleeve is urged by the spring into engagement with a cam member on the yoke of the bent axis unit.

7 Claims, 5 Drawing Sheets

SINGLE-PIECE PROPORTIONAL CONTROL

CROSS-REFERENCE TO RELATED APPLICATIONS

This application is a continuation-in-part of U.S. Provisional Application No. 60/121,861 filed Feb. 26, 1999; U.S. Provisional Application No. 60/121,948 filed Feb. 26, 1999; U.S. Provisional Application No. 60/121,947 filed Feb. 26, 1999; and U.S. patent application Ser. No. 09/390,128 filed Sep. 3, 1999.

BACKGROUND OF THE INVENTION

The present invention relates to hydraulic units of the bent axis type. More particularly, this invention relates to a swinging yoke type bent axis hydraulic unit.

Bent axis hydraulic units have been known for many years. The most widespread or common of the bent axis designs utilizes a "tilting block" such as disclosed by Forster in U.S. Pat. No. 4,893,549. A rotatable cylindrical drum or cylinder block kit has a plurality of axial pistons therein supported on a nonrotatable swivel carriage on its axis of rotation. The swivel carriage has a convex end face positioned against a concave swivel carriage guide surface. The swivel carriage guide surface is part of the swivel carriage housing, which is attached to the machine.

Other bent axis units utilize a "swinging yoke" configuration. The cylinder block kit is carried by the yoke and swings with it to vary the displacement of the unit.

A control mechanism of the prior applications includes a stepper motor, control member with an elongated bore, an elongated hydraulic fluid control spool movably mounted in the bore and positioned by the cooperative functions of the stepper motor and the feedback signal to the spool which senses a cam on a pivotal yoke, and a pair of servo pistons operatively mechanically connected to the yoke and hydraulically connected to the fluid control spool.

The principal object of this invention is to replace the stepper motor with a proportional solenoid fluid valve which is operatively connected to a computer.

A further object of this invention is to have one end of the fluid control spool influenced by the solenoid fluid valve, and the other end influenced by a spring loaded feedback system operatively connected to the yoke or pivotal member of the system.

These and other objects will be apparent to those skilled in the art.

SUMMARY OF THE INVENTION

A variable displacement bent axis hydraulic unit has a pivotal member for carrying a cylinder block pivotally mounted to a fixed frame on the unit. A close loop control mechanism for changing the hydraulic displacement of the unit and including at least one movable servo piston is operatively connected to the pivotal member. The control mechanism includes a feedback member operatively connected to the pivotal member so as to provide feedback to the control mechanism regarding the pivotal position of the pivotal member relative to the fixed frame. The control mechanism is operative to vary the servo piston to change the pivotal position of the pivotal member. The control mechanism includes an elongated bore with a control valve mounted therein. The feedback member comprises a sleeve downstream from a spool slidably mounted within the bore with one end slidably mounted in the control bore and the other end protruding from the control housing. That end engages the pressure feedback sleeve to engage the pivotal member. A pair of spaced apart servo bores with servo pistons therein in the control housing are in hydraulic communication with the bore and the spool. The pistons are operatively connected to the pivotal member for rotating the same in one of two directions as determined by the position of the spool in the bore.

The spool is longitudinally energized in one direction by the displacement feedback sleeve on one end, and hydraulic pressure imposed on the other end. The hydraulic pressure is induced by a computer connected to a proportional solenoid fluid valve controlled by the computer and in operative fluid engagement with one end of the spool.

DESCRIPTION OF THE PREFERRED EMBODIMENT

Figure 1:
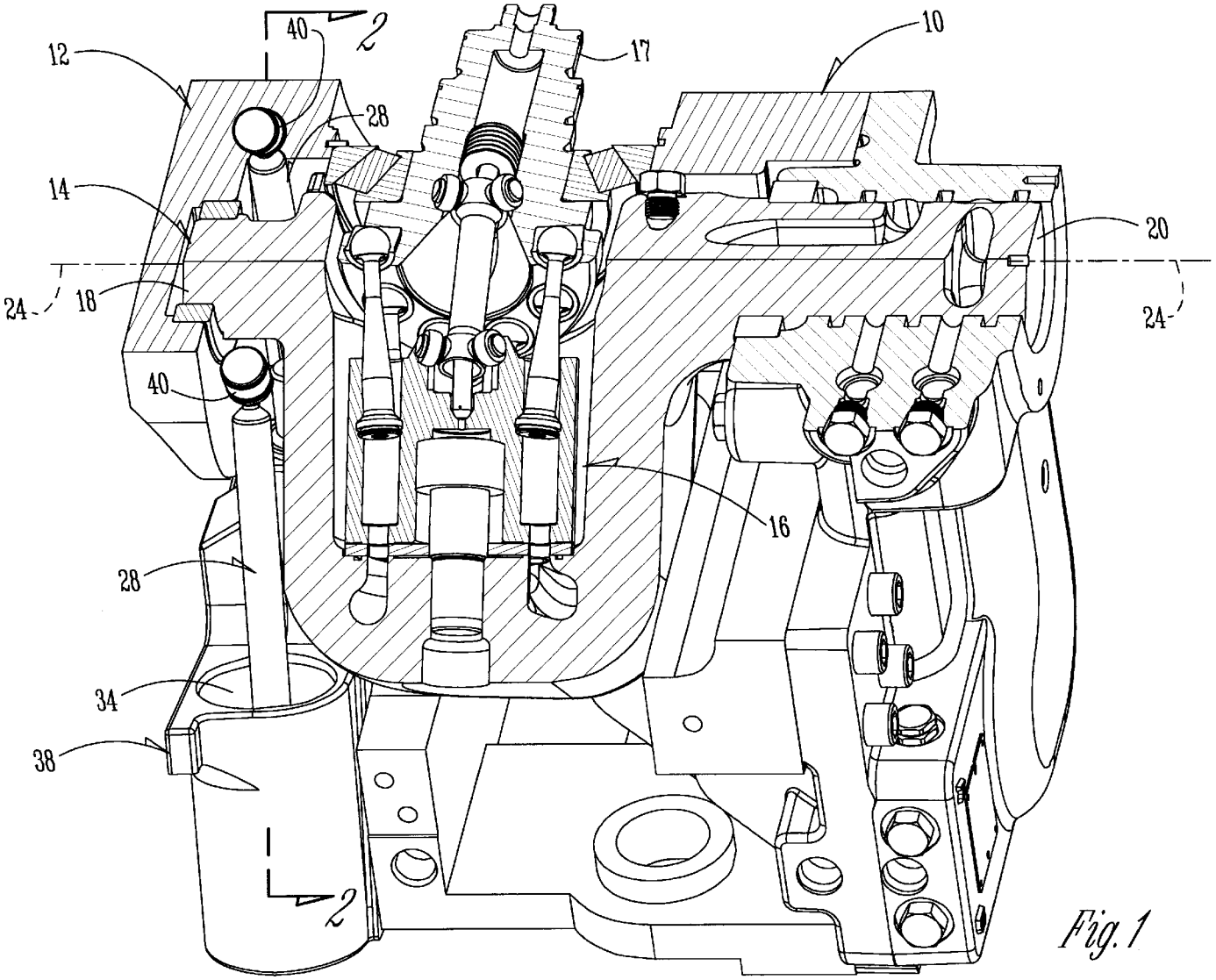
FIG. 1 is perspective view of a bent axis hydraulic unit to which the control system of this invention can be adapted. Portions of the housing have been removed for clarity to better expose some of the internal components.

FIG. 1 depicts a bent axis variable displacement hydraulic unit 10. The bent axis unit 10 includes a supporting frame or housing 12, much of which is irrelevant to this invention and therefore has been cut away to allow the internal components to be seen more clearly. The displacement of the bent axis unit 10 is varied by a single-piece swinging yoke 14 which carries a conventional cylinder block or cylinder block kit 16 drivingly connected to a main shaft 17 that is rotatably supported in the housing 12. The yoke 14 is forced to swing or pivot about a pair of opposing pivot arms 18, 20 by control 22 (FIG. 1). Preferably the arms 18, 20 share a common, fixed pivot axis 24.

Figure 2:
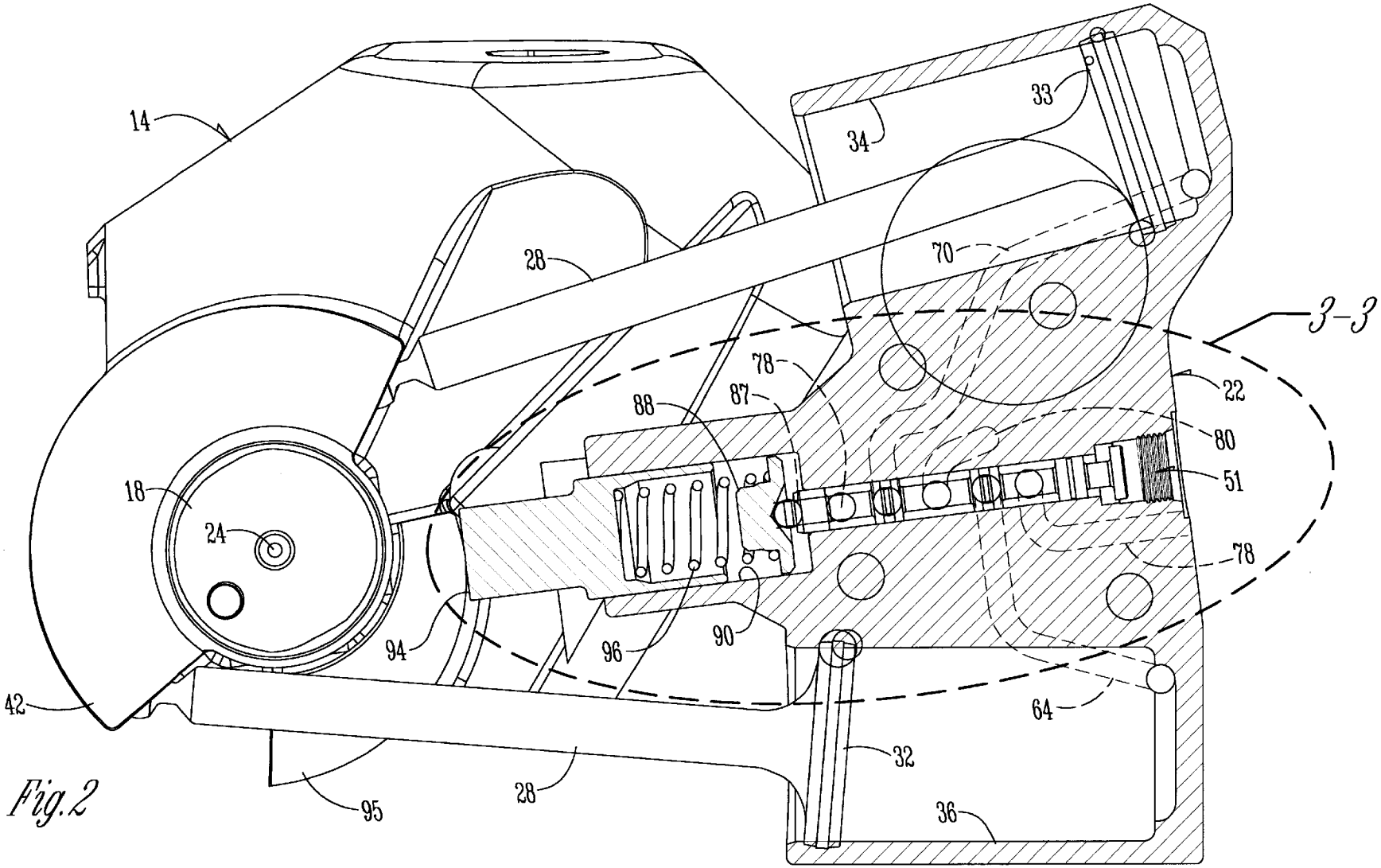
FIG. 2 is an sectional view taken on line 2—2 of FIG. 1 with the housing portions being restored.
Figure 3:
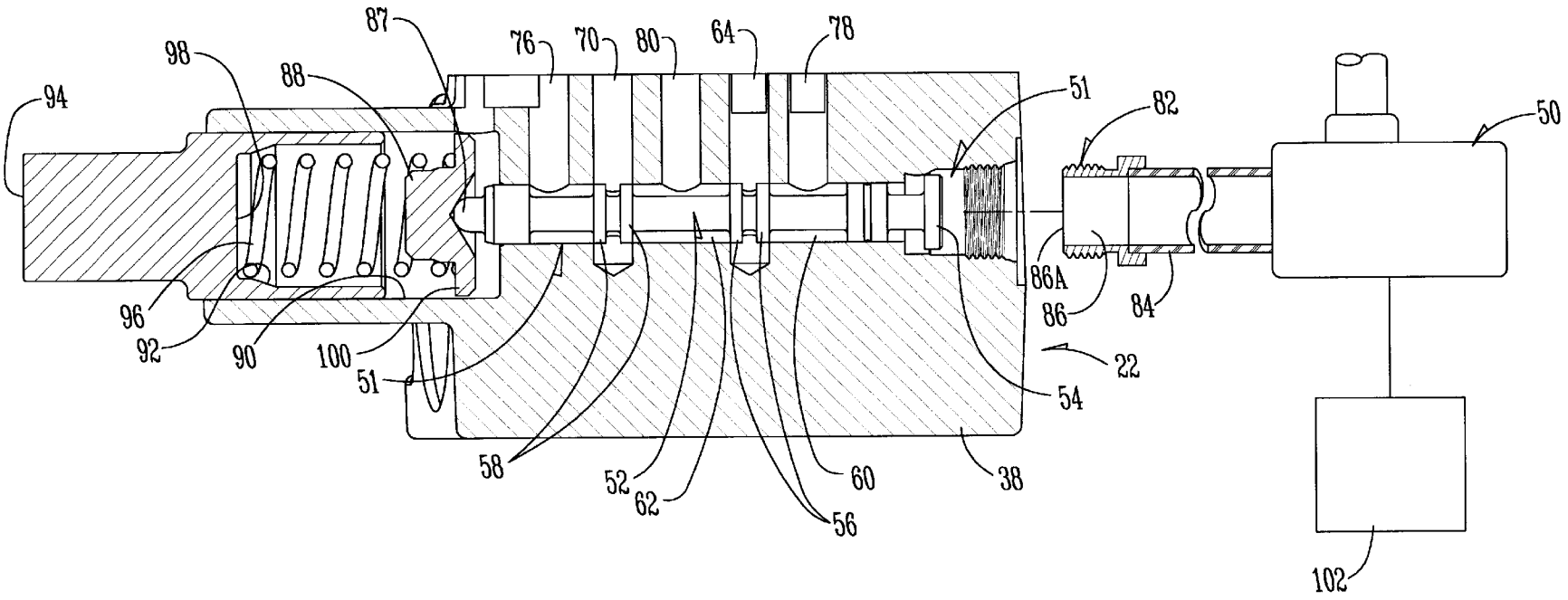
FIG. 3 is an enlarged scale sectional view of the area 3—3 of FIG. 2, with the solenoid fluid valve and computer shown in schematic form.
Figure 4:
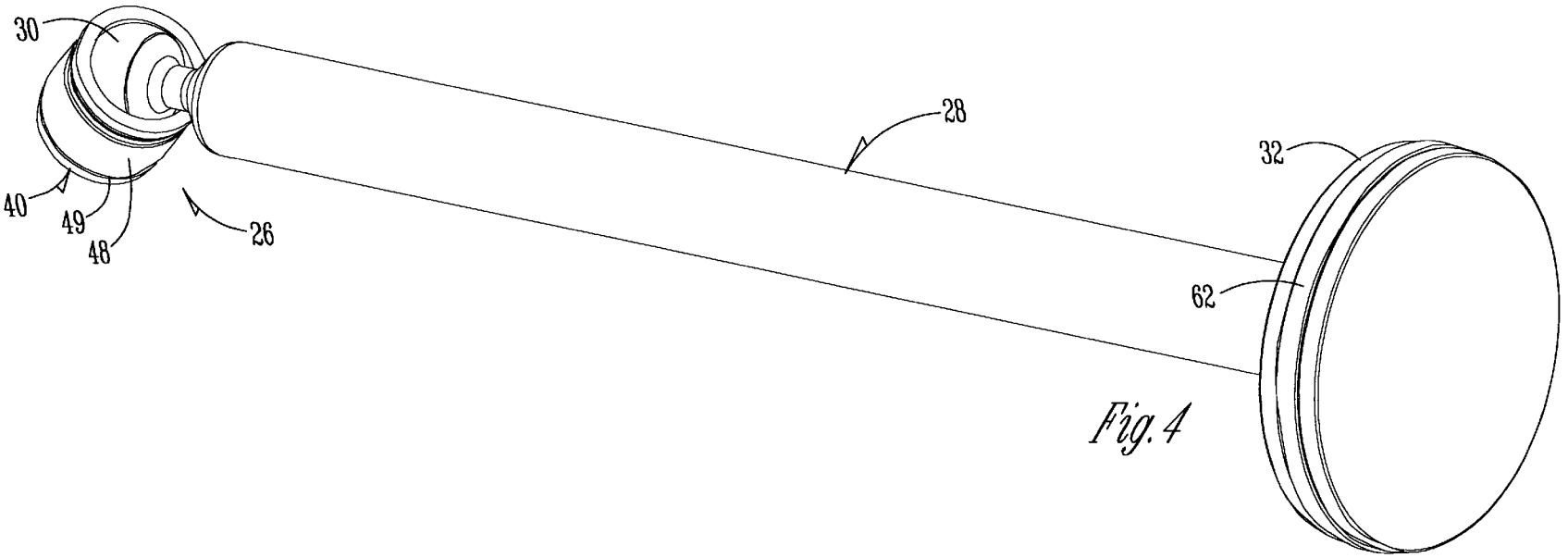
FIG. 4 is a perspective view of the actuator rod assembly and ball-and-socket joint.
Figure 5:
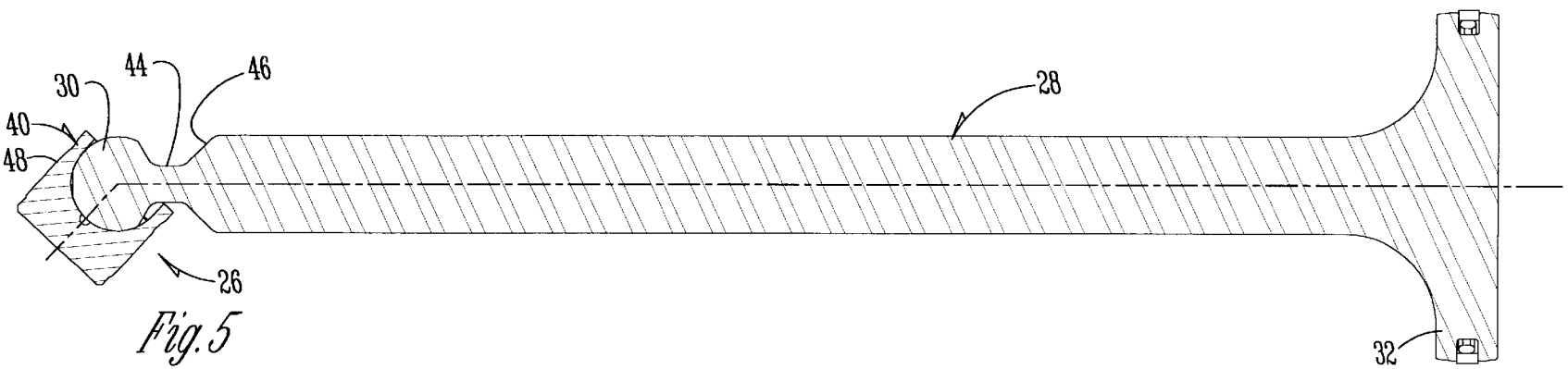
FIG. 5 is a cross-sectional view of the assembly of FIG. 4.

As seen in FIGS. 1, 2, 4 and 5, a universal ball-and-socket joint 26 is operatively associated with the yoke 14 at the arm 18. An elongated actuator rod 28 has a substantially external spherical surface 30 on a first end and a servo piston 32 on the second end. As seen in FIG. 1, a similar actuator rod 28 is provided on the other side of the axis of rotation 24. The servo pistons 32 are slidably, sealingly, and tiltably received respectively in servo bores 34 and 36 of a one-piece control housing 38 (FIG. 3). Although many arrangements are possible, each of the servo bores 34, 36 preferably has a central axis which is skewed with respect to that of the other servo bore. The bores 34, 36 therefore do not need be parallel to each other. As a result, the central axes of the servo bores 34, 36 can form a variety of angles with respect to the arm 18. Displacement control could be applied at arm 20, as well as or instead of arm 18. Thus, force can be applied by the actuator rod 28 to swing or rotate the yoke 14 up to greater than 90°. In other words, a range of up to greater than plus or minus forty-five degrees from the neutral or midpoint position is provided. The control forces on the yoke 14 can reside in more than one plane.

Referring to FIG. 1, (where the control housing 38 has been removed) the various components required for servo piston actuation of the swinging yoke 14 are illustrated. A socket member 40 (FIG. 5) is interposed between the spherical surface 30 of the actuator rod 28 and the control arm 18 on the yoke 14 (FIG. 1).

The actuator 28 has a ball end or spherical surface 30 generally opposite a servo piston 32. The rod 28 has a sturdy cross-section and is formed of a rigid material having sufficient strength to handle the expected loads and stresses. The actuator rod 28 has a reduced diameter portion 44 (FIG. 5) rearwardly adjacent the ball end 30. A tapered portion 46 connects the reduced diameter portion 44 with the intermediate portion of the actuator rod 28.

The mating portion of the ball-and-socket joint includes a socket 48 which is preferably constructed of a malleable material, such as brass. The socket 48 is crimped or otherwise attached to the ball end 30 of the actuator rod 28 so that the socket 48 freely pivots around the ball end 30. The reduced diameter and tapered portions 44, 46 help provide clearance for relative movement of the ball and socket. The socket 48 has a substantially cylindrical outer surface, an open end, and a closed end.

The control 22 also includes a proportioned solenoid hydraulic valve 50 located remotely from a control bore 51 which is located between the servo bores 34 and 36 in the control housing 38 (FIG. 3). The solenoid valve 50 operatively engages a linearly actuated hydraulic displacement control spool 52 which has the necessary conventional and appropriate porting to port oil to the servo bores 34, 36 respectively based on fluid pressure commands from the computer 102 which controls the solenoid valve.

The spool 52 has a flat head 54, and pairs of spaced flanges 56 and 58. A first fluid compartment 60 is located between head 54 and the flange 56; a second fluid compartment 62 is located between pairs of flanges 56 and 58. Fluid passage 64 is connected to servo bore 36 and servo piston 32. Fluid passage 70 is connected to servo bore 34 and servo piston 33. Fluid passageway 76 and 78 are connected to a fluid reservoir (not shown), and fluid passage 80 is connected to a source of pressurized hydraulic fluid normally at a constant pressure (not shown).

The hose fitting 82 (FIG. 3) is mounted in the upstream end of bore 51 and is adapted to connect a hydraulic line 84 which in turn is connected to solenoid valve 50. The bore 86 in fitting 82 supplies pressurized fluid from valve 50 to the flat head 54 of spool 52. The forward end 86A of fitting 82 can limit the rearward movement of spool 52 by abutting spool head 54.

The end 87 of spool 52 is rigidly secured in any convenient way to spring guide 88 which is slidably mounted in enlarged bore 90 in control housing 38. The end 87 protrudes into bore 90. A displacement feedback sleeve 92 is slidably mounted in bore 90 and has an outer protruding contact surface 94 which typically would contact yoke cam 95 (FIG. 2). Sleeve 92 is hollow and is open at its upstream end. Spring 96 bears between the inner end 98 of sleeve 92 and flange 100 on spring guide 88.

Figure 6:
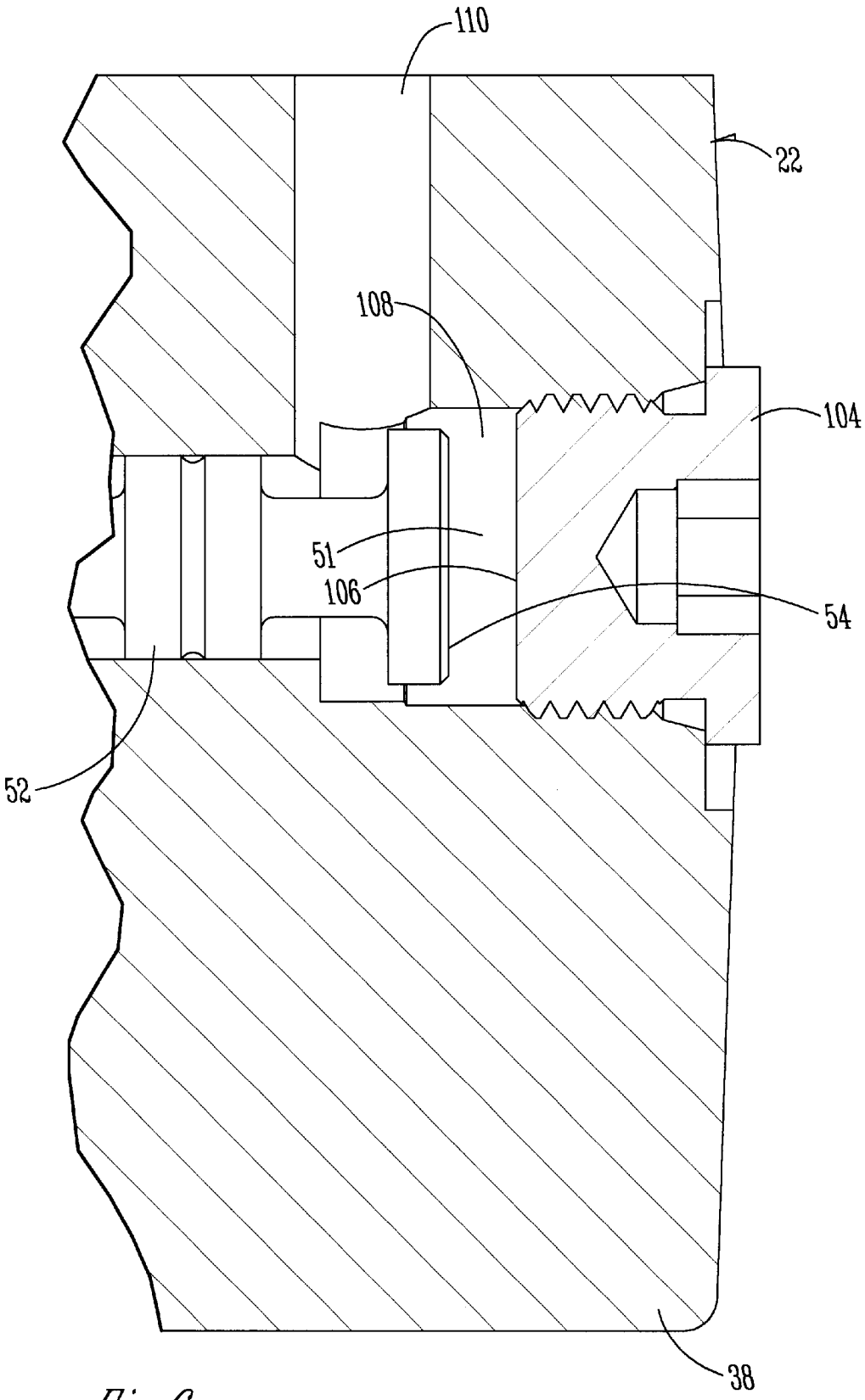
FIG. 6 is a partial sectional view similar to the right-hand end of FIG. 3 showing an alternative construction.

FIG. 6 shows an alternative construction to the fitting 82 shown at the right-hand end of FIG. 3. A plug 104 is threadably inserted into the end of bore 51 in place of hose fitting 82. Plug 104 has an inner face 106 which will limit the movement in a right-hand direction of spool 52 in bore 51. The space 108 existing forwardly of plug 104 and around head 54 of spool 52 is in communication with 110 which is fluidly connected to solenoid fluid valve 50 in lieu of fluid hose 84 shown in FIG. 3.

In operation, computer 102 instructs the valve 50 as to the pressure to be applied to end 54 of spool 52. At the same time, displacement feedback sleeve 92 senses the pivoted position of yoke 14 from cam 95, and a force is transmitted to the end 87 of spool 52 by way of sleeve 92, spring 96 and the flange 100 on spring guide 88. The spool 52 thereupon finds its place in bore 51 from the resultant longitudinal forces exerted thereon at end 87, and the hydraulic fluid pressure on head 54 from the solenoid valve. The valve 50 controls spool 52, and the feedback sleeve provides only a reactive force. The pressurized hydraulic fluid entering bore 51 from passage 86 permits fluid to transfer to servo bore 34 when the spool 52 in FIGS. 2 and 3 is moved to the left to align compartment 62 to passage 70 (FIG. 3). Similarly, the fluid moves to bore 32 when the net longitudinal forces on spool 52 move the fluid compartment 62 into fluid communication with passageway 64. The servo pistons 32 and 33 obviously react to the flow of fluid through passageway 64 and 70, respectively, to tilt the yoke to the position required by the computer 102.

Thus, from the foregoing, it is seen that this invention would achieve at least all of its stated objectives.

What is claimed is:

1. A swingable variable displacement bent axis hydraulic unit, comprising, a housing;

a pivotal member pivotally mounted in the housing so as to pivot about a pivot axis, the pivot member being adapted to carry a hydraulic cylinder block and including a pivot arm extending along the pivot axis and a cam member on the pivot arm;

a closed loop control mechanism in the unit for changing the hydraulic displacement of the unit;

the control mechanism including a pair of servo pistons drivingly connected to the pivot arm, a control housing including a pair of spaced servo bores therein for slidingly receiving the servo pistons respectively and a control bore, the control bore including a main bore remote from the cam member and a counterbore adjacent the cam member and having a longitudinally disposed entrance directed toward the pivot axis;

a control valve mounted in the control bore, the control valve including a spool slidably mounted within the main bore of the control bore, a displacement feedback sleeve having a diameter greater than the main bore and including one end slidably mounted in the counterbore and another end protruding longitudinally from the control housing through the entrance so as to contact the cam member on the pivotal member, and a spring operatively interposed between the spool and the displacement feedback sleeve;

the servo pistons being in fluid communication with the control bore and the spool;

the servo pistons being operatively connected to the pivotal member for rotating the same in one of two directions as determined by the position of the spool in the control bore;

a proportional solenoid fluid valve fluidly connected to an end of the spool opposite of the displacement feedback sleeve, and the solenoid fluid valve being operatively connected to a computer whereby the computer controls the proportional solenoid fluid valve and thus provides a fluid pressure adjacent said end of the spool opposite of the displacement feedback sleeve so as to position the spool within the main bore and thereby control the displacement of the unit through the servo pistons.

2. The device of claim 1 wherein the spring is a compression spring.

3. The device of claim 2 wherein the control mechanism includes fluid passageways in communication with the control bore and fluid compartments around the spool to permit the spool in varying longitudinal positions to direct hydraulic fluid to the servo bore to move the servo pistons and thereby vary the hydraulic displacement of the unit.

4. The device of claim 1 wherein a stop element in the main bore of the control bore limits the movement of the spool in a direction away from the pressure feedback sleeve.

5. The bent axis unit of claim 1 wherein the control bore is located between the servo bores in the control housing.

6. The bent axis unit of claim 1 wherein the control housing is a unitary one-piece control housing.

7. The bent axis unit of claim 1 wherein one end of the displacement feedback sleeve has an cavity therein for receiving the spring and another end of the sleeve is closed.

* * * * *